United States Patent [19]

Ephraim

[11] Patent Number: 4,878,588

[45] Date of Patent: Nov. 7, 1989

[54] BABY NURSING BOTTLE WITH TEMPERATURE INDICATOR

[76] Inventor: Jacob Ephraim, 24419 Plumtree Ct., West Hills, Calif. 91307

[21] Appl. No.: 203,693

[22] Filed: Jun. 7, 1988

[51] Int. Cl.[4] ..... A61J 9/02

[52] U.S. Cl. ..... 215/11.2; 215/365; 374/150

[58] Field of Search ..... 215/11.1–11.6, 215/365, 366, 367; 374/147, 150, 151, 157, 162; D24/47; 128/359, 360; 264/512, 513, 523

[56] References Cited

U.S. PATENT DOCUMENTS

| | | | |
|---|---|---|---|
| D. 283,920 | 5/1986 | Chen | D24/47 |
| 1,423,038 | 7/1922 | Sims | 374/150 |
| 2,091,605 | 8/1937 | McCarty | 215/11.2 |
| 2,094,520 | 9/1937 | Benamy | 73/343 |
| 2,319,101 | 5/1943 | Anderson | 73/343 |
| 2,346,832 | 4/1944 | Eisele | 73/343 |
| 2,357,477 | 9/1944 | Killman | 73/343 |
| 2,357,692 | 9/1944 | Saffady | 73/343 |
| 2,648,226 | 8/1953 | Finch | 73/343 |
| 2,799,167 | 7/1957 | Loconti | 73/356 |
| 2,814,202 | 11/1957 | Frans | 73/343 |
| 2,981,108 | 4/1961 | Andersen et al. | 73/343 |
| 3,125,984 | 3/1964 | Okuyama | 116/114 |
| 3,430,491 | 3/1969 | Gignilliat, III | 73/358 |
| 3,576,761 | 4/1971 | Davis | 252/408 |
| 3,580,079 | 5/1971 | Crites et al. | 73/358 |
| 3,661,142 | 5/1972 | Flam | 128/2 H |
| 3,682,344 | 8/1972 | Lopez | 215/11.1 |
| 3,782,195 | 1/1974 | Meek et al. | 73/343 |
| 3,859,856 | 1/1975 | Keele et al. | 73/356 |
| 3,864,976 | 2/1975 | Parker | 73/356 |
| 3,878,722 | 4/1975 | Crites | 73/356 |
| 3,961,530 | 6/1976 | Helgesson | 73/339 R |
| 4,022,060 | 5/1977 | Rebhan | 215/11.2 X |
| 4,070,912 | 1/1978 | McNaughtan et al. | 73/356 |
| 4,156,365 | 5/1979 | Heinmets et al. | 73/343 B |
| 4,538,926 | 9/1985 | Chretien | 374/150 |
| 4,555,040 | 11/1985 | Butenschön | 215/365 |

FOREIGN PATENT DOCUMENTS

| | | | |
|---|---|---|---|
| 2828328 | 1/1980 | Fed. Rep. of Germany | 215/11.2 |
| 3614835 | 11/1987 | Fed. Rep. of Germany | 215/11.2 |
| 2291683 | 6/1966 | France | 215/11.2 |
| 2426249 | 1/1980 | France | 374/150 |
| 1341735 | 12/1973 | United Kingdom | 215/11.2 |

*Primary Examiner*—Sue A. Weaver

*Attorney, Agent, or Firm*—Lawrence N. Ginsberg

[57] ABSTRACT

A baby feeding bottle having a side wall with a sealed elongated chamber formed therein. The elongated chamber has a commercially available liquid crystal-type strip thermometer disposed therein having temperature indications in a selected temperature range around 37° C.

7 Claims, 1 Drawing Sheet

BABY NURSING BOTTLE WITH TEMPERATURE INDICATOR

BACKGROUND OF THE INVENTION

1. Field of the Invention

This invention relates to improvements in baby feeding bottles and particularly to an improvement in the manner in which the temperature of the liquid within the bottle is determined.

2. Description of the Prior Art

Based upon the fact that the temperature of mother's milk is approximately 37° C., it has been recognized that milk/formula given to the unweaned should be at approximately this temperature. Liquid above or below this temperature may be rejected by the baby. If the liquid is accepted and is too hot, the baby's lips and mouth may be burned. If the liquid is too cold, it may bring a case of indigestion.

In the past, the most common method for determining the temperature of the liquid was simply the tactile feeling of the fingertip or the hand palm of a person having access to the feeding bottle. The determination was therefore often reliable as it simply depended upon the thermal feeling of a particular person having access to the feeding bottle and furthermore was not free from the influences of atmospheric or room temperature.

Some early temperature indicator means for baby feeding bottles involved the use of bimetallic coils. See, for example, U.S. Pat. No. 2,648,226 issued to P. R. Finch and U.S. Pat. No. 2,814,202 issued to R. D. Frans. Other temperature indicator means included the use of liquid bulb-type thermometers attached, by various methods, to the feeding bottle. See, for example, U.S. Pat. No. 2,091,605 issued to C. E. McCarty, U.S. Pat. No. 2,981,108 issued to A. K. Andersen et al, U.S. Pat. No. 2,319,101 issued to S. S. Anderson, U.S. Pat. No. 1,423,038 issued to V. I. Sims, U.S. Pat. No. 2,357,477 issued to R. T. Killman, U.S. Pat. No. 2,346,832 issued to L. Eisele, U.S. Pat. No. 2,094,520 issued to J. Benamy, U.S. Pat. No. 2,357,692 issued to T. F. Saffady and U.S. Pat. No. 3,682,344 issued to A. N. Lopez.

With respect to using liquid bulb-type thermometers there is the obvious breakage resulting from the fact that the bottle is being used by an infant and thus might be dropped or the bottle misused by the infant, thus possibly leading to cuts or poisoning. Furthermore, the predominant use of dishwashers and microwave ovens has effectively eliminated the ability to use liquid bulb-type thermometers in baby bottles.

U..S. Pat. No. 3,125,984, issued to H. Okuyama discloses a baby feeding bottle with a side wall having a plurality of spaced recesses. Each recess contains a strip of wax, the wax in each recess having a distinct melting temperature. Each recess also has a marker (e.g. a colored marker), located inwardly from its respective strip of wax. Thus, when the bottle is heated to different temperatures the wax melts to be transparent revealing the marker to the viewer and giving an indication of temperature. Disadvantages of the Okuyama device includes the expense in manufacturing as a result of the numerous parts. If convenient temperature readings are desired, several recesses and concomitant waxes and temperature markers would be required.

German Offenlegungsschrift 28 28 328 discloses a baby feeding bottle with a thermometer attached to either the inside or outside of the wall of the baby bottle. The temperature indicator may be different from a thermometer scale such as a color indicator. Disadvantages of the German device include the fact that by virtue of being a separate unit, the thermometer might be broken away, misplaced or damaged through normal misuse by the handler. These problems may be amplified if the thermometer is attached to the inner wall because the damaged bottle/thermometer may be used without even suspecting that it might be damaged. Using a damaged indicator unit could cause unintentional harm to the baby (liquid served in the bottle being too hot or too cold).

U.S. Pat. No. 4,156,365 issued to F. Heinmets et al entitled, "Temperature Indicator", discloses the use of a layer of thermochromic paint as an indicator of temperature on food-holding vessels. The paint is used for the specific temperature range of between 55°-70° C. to provide indications of the levels of temperature of which denaturation of the food, microbial, growth in the food and tissue injury to the consumer of food carried by the utensil would be likely and reverse the color changes when re-cooled.

OBJECTS AND SUMMARY OF THE INVENTION

It is therefore a principle object of the present invention to provide a baby feeding bottle in which temperature readings of any liquid therein may be conveniently taken.

Another object is to provide a baby feeding bottle having built-in temperature including means which is lightweight and does not interfere with the shape of the bottle, thereby allowing easy handling by the baby.

Another object is to provide a baby feeding bottle which is safe even with unpredictable use and mishandling by a baby.

Yet another object is to provide a baby feeding bottle having integral temperature indicating means which is safe for use in both dishwashers and microwave ovens.

Yet another object is to provide a baby feeding bottle which can be placed in boiling water for disinfectant purposes.

Still another object is to provide a low cost baby feeding bottle.

Other objects, advantages and novel features of the present invention will become apparent from the following detailed description of the invention when considered in conjunction with the accompanying drawing.

These objects are achieved by the baby feeding bottle of the present invention, which in its general aspects, comprises a baby bottle having a side wall with an elongated sealed spaced formed therein. The elongated space has a commercially available liquid crystal-type strip thermometer disposed therein having temperature indications in a selected temperature range around 37° C.

In its narrower aspects, the baby bottle is formed of injection-molded or bow-molded plastic. The elongated space is formed by a recess in the side wall. During its manufacture, after the strip thermometer is in place, a clear cover is placed and sealed over the recessed portion. Thus, the strip thermometer is sealed within the side wall of the bottle.

Use of a liquid crystal-type strip thermometer allows heating in a microwave oven and cleaning in a dishwasher. Furthermore, actually incorporating the thermometer within the side wall prevents the thermometer from being handled and from coming in contact with the liquid within the bottle thereby minimizing the risks of misuse, damage, and misplacement of the thermometer. Costs are held at a minimum by reducing the number of parts.

BRIEF DESCRIPTION OF THE DRAWINGS

The same elements or parts throughout the figures are designated by the same reference characters.

DETAILED DESCRIPTION OF THE INVENTION

Figure 1:
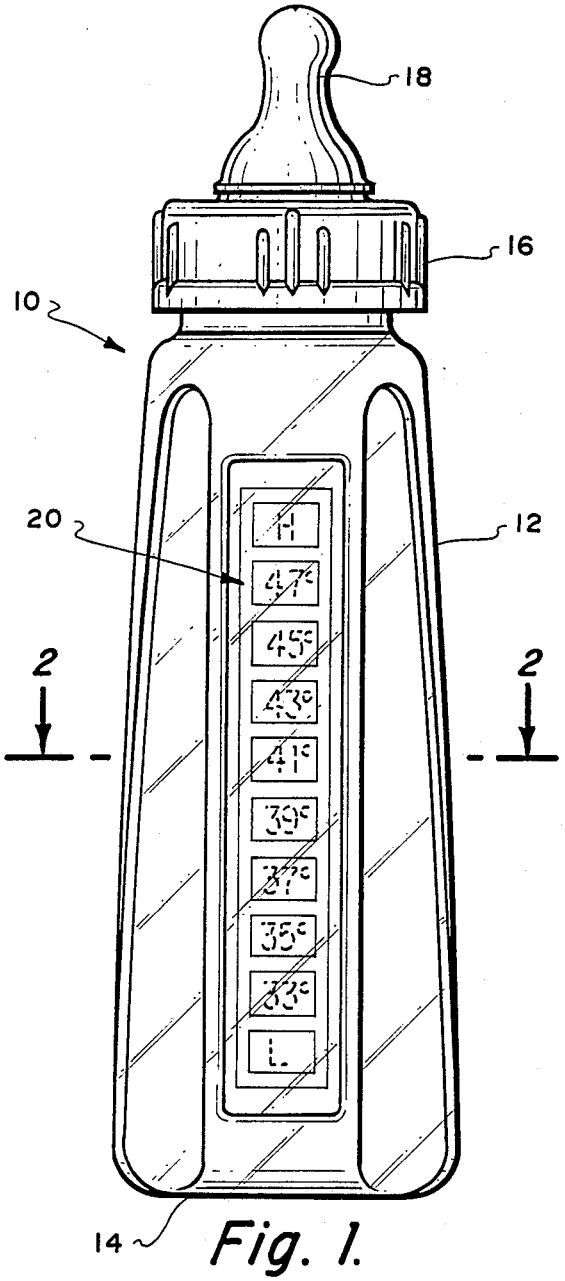
FIG. 1 is a front elevation of the baby feeding bottle of the present invention.

Referring to the figures and characters of reference marked thereon, the baby feeding bottle of the present invention is generally designated 10 in FIG. 1.

The baby feeding bottle 10 comprises a commercially shaped baby bottle, that is, having an elongated hollow cylindrical vessel constituted by an integral side wall 12 and a bottom end wall 14. The bottle 10 is constructed with a universal threading (not shown) at the opposite (top) end to allow for usage and interchangeability of a cap 16 with nipple 18. The universal cap/nipple is available as an off-the-shelf item.

The baby feeding bottle 10 has a liquid crystal-type thermometer generally designated 20 mounted within the side wall 12 thereof preferably in a vertical orientation. However, orientation of the thermometer in other positions will not detract from the invention's advantages.

Figure 3:
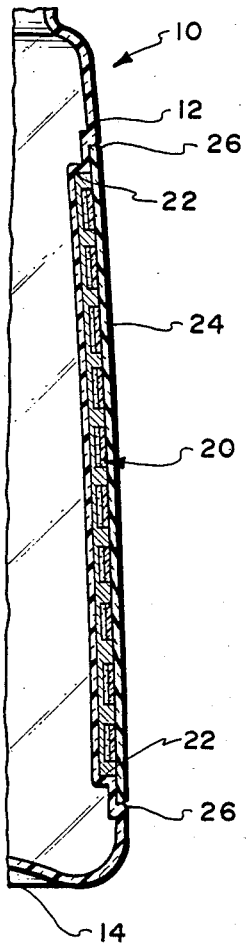
FIG. 3 is a cross-sectional view of the baby feeding bottle taken along line 3—3 of FIG. 2.
Figure 2:
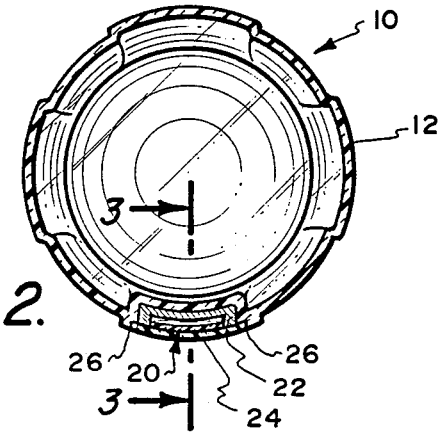
FIG. 2 is a view, partially in cross-section, of the baby feeding bottle taken along line 2—2 of FIG. 1.

Referring to FIGS. 2 and 3, the side wall 12 has an elongated recessed portion 22 slightly larger than the length and width of the strip thermometer 20 which is disposed therein. A clear cover 24 is sealably secured at the periphery 26 of the recessed portion 22. The baby feeding bottle 10 including the cover 24 is preferably formed of injection molded plastic. The cover 24 is preferably secured into position by ultrasonic bonding techniques.

A conventional liquid crystal-type strip thermometer such as that commercially available by American Thermometer Company may be utilized. The strip thermometer 20 has numeral designations preferably ranging from 33° C. to 41° C. which are revealed at those respective temperature environments. (FIG. 1 shows all the numerals simultaneously revealed for purposes of illustration.) Of course, the corresponding Fahrenheit scale can alternately be used.

To assist in the identification of the temperature of the liquid within the bottle, the background to the numerical scale contains varying colors which are revealed at each respective temperature.

Figure 4:
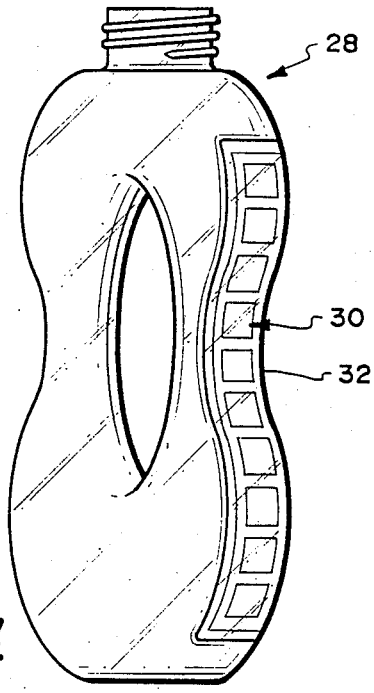
FIG. 4 is a perspective view of an alternately-shaped baby feeding bottle incorporating the principles of the present invention.

Baby bottles are currently being marketed that have curved elongated shapes. The principles of the subject invention are particularly adaptable to a curved surface inasmuch as a strip thermometer may be bent to conform with such a smooth curved surface. Referring now to FIG. 4, an elongated curved baby bottle 28 is shown containing strip thermometer 30 disposed in the curved sidewall 32 thereof. The thermometer is emplaced and sealed as described in the previous embodiment.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A baby feeding bottle, comprising:

an elongated, hollow vessel constituted by an integral side wall and an end wall and being open at the other end, said side wall having a smooth, curved section thereon with a varying gradient, said smooth curved section including an elongated, smooth, inwardly recessed portion with a similarly varying gradient thereon and a clear cover ultrasonically bonded to the periphery of said recessed portion, said clear cover having a similarly varying gradient for covering said recessed portion in a flush manner with respect to said side wall, an elongated closed space being formed between said recessed portion and said cover; and a liquid crystal-type strip thermometer disposed within said elongated space, said strip thermometer having temperature indications in a selected temperature range around 37° C.

2. The baby feeding bottle of claim 1 wherein said temperature indications are by color and numeral designations.

3. The baby feeding bottle of claim 1 wherein said temperature indications are by color designations.

4. The baby feeding bottle of claim 1 wherein said temperature indications are by numeral designations.

5. The baby feeding bottle of claim 1 wherein said selected temperature range is between 33° C. and 41° C.

6. The baby feeding bottle of claim 1 wherein said hollow vessel is formed of injection molded plastic.

7. The baby feeding bottle of claim 1 wherein said hollow vessel is formed of blow-molded plastic.

* * * * *